United States Patent [19]

Marbourg, Jr.

[11] 4,455,898

[45] Jun. 26, 1984

[54] TOOL FOR CAPTURE, CONTROL AND MANIPULATION OF THREADED FASTENERS

[76] Inventor: Edgar F. Marbourg, Jr., 437 Hillcrest Rd., San Carlos, Calif. 94070

[21] Appl. No.: 385,540

[22] Filed: Jun. 7, 1982

[51] Int. Cl.[3] ..... B25B 23/08

[52] U.S. Cl. ..... 81/454

[58] Field of Search ..... 81/451–458, 81/90 C, 125

[56] References Cited

U.S. PATENT DOCUMENTS

| | | | |
|---|---|---|---|
| 796,154 | 8/1905 | Schulze | 81/453 |
| 1,300,275 | 4/1919 | Johnson | 81/90 C |
| 1,772,040 | 8/1930 | Dunlea | 145/61 EA |
| 2,796,100 | 6/1957 | Dierker | 81/457 |
| 4,190,091 | 2/1980 | Colognori | 81/453 |

*Primary Examiner*—James L. Jones, Jr.

*Attorney, Agent, or Firm*—Marshall C. Gregory

[57] ABSTRACT

In combination with its own bit, or with a screwdriver, a barrel made of a stiffly flexible material, preferably a specified plastic, slides over the bit or screwdriver shaft, and provides at one end a gripping head for screw heads, and at the other a quick-lock clutch operated by a twist of a rotary collar. The gripping head can not only grip surely a screw head placed in it, as for starting, but can locate by feel an installed screw in a hidden recess difficult of access, and facilitate one-handed withdrawal of the screw, with sure retention of the head. The device can be made as a screwstarter, with a set of sizes and bits for all sizes and type of screws, or as barrels adaptable to the full range of available and existing screwdrivers. A split-barrel variant can be assembled with the use of threaded collars, one of which is the clutch collar and the other the gripping head, over the shaft of a screwdriver which has a widened blade, square shaft, or for some other reason requires a special adaptation. The device also acts as a safety device to guard against cuts and electrical shock.

12 Claims, 14 Drawing Figures

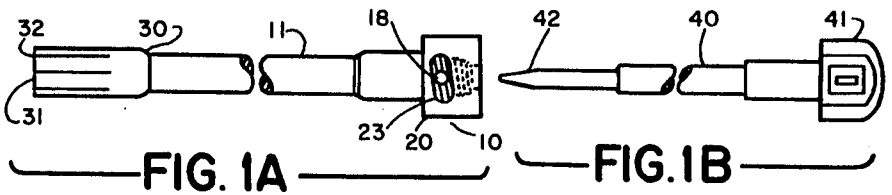
FIG. 1A
FIG. 1B
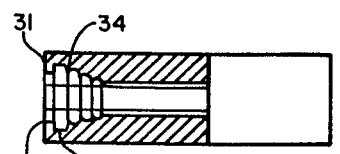
FIG. 1C
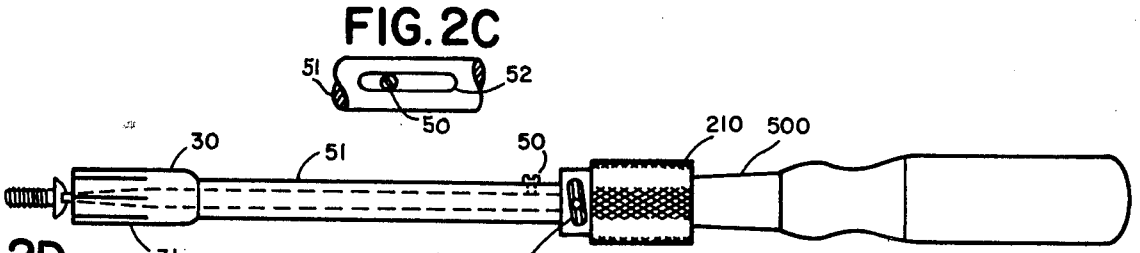
FIG. 2A
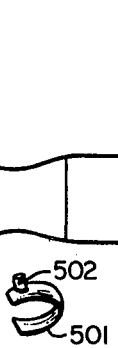
FIG. 2B
FIG. 2C
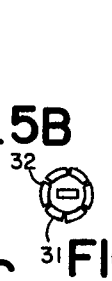
FIG. 2D
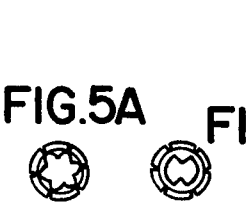
FIG. 5A
FIG. 5B
FIG. 5C
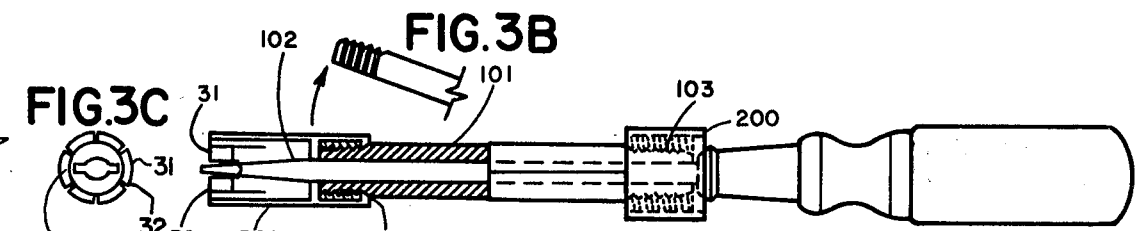
FIG. 3A
FIG. 3B
FIG. 3C
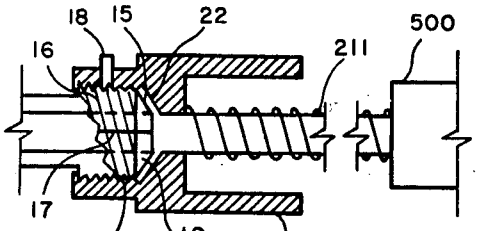
FIG. 4

TOOL FOR CAPTURE, CONTROL AND MANIPULATION OF THREADED FASTENERS

SUMMARY OF THE INVENTION

1. Field of the Invention.

The invention is an improvement applicable to a common group of tools, namely screwdrivers and related tools for finding, removing, starting and driving screws, machine screws and bolts and analagous type fasteners in their various sizes and forms. It may be, in one of its forms, adapted to existing screwdrivers of all types, including not only the conventional flat-tipped type for slotted-head screws, and the widely known Phillips head type, but also special designs such as the Pozidriv, clutch, Scrulox, Allen head (hex), Torx and Reed Prince.

In a field of art as old and basic as this one, there is a broad base of existing art. The individual elements of this invention, if dissociated and taken separately, are not unknown, however their combination in this device produces a tool or family of tools which perform functions which cannot all be accomplished, nor perhaps any of them as well, with any of the prior devices known to applicant, one skilled in this art. It represents a significant improvement and progress in the art.

2. Background of the Invention

One of the most annoying and difficult problems in the use of screws and kindred fasteners is that of inserting and driving them, or as a corollary locating and removing them, in recesses or places where it is difficult to see the head or socket, and where in addition it is very likely impossible to use two hands or an auxiliary tool. In these situations, it is necessary to start and drive the screw to have a tool which will hold the screw itself, but yet release when necessary. It is further necessary, in locating and removing a screw in such a location, to have a tool which will facilitate first finding the screw and centering the bit of the tool to register with the head, then also capture it dependably and withdraw it as it is unscrewed.

Many devices have been offered in an approach to solving this problem, or these associated problems, as summarized below in the discussion of the prior art. Most of them require two handed operation of the tool to lock or affix it to a screw head, are difficult to apply, or perhaps jam themselves under the head after driving, will not fit in narrow recesses or depressions, or simply do not perform all the operations required. The proposed invention not only does perform these operations simply and efficiently, it offers other advantages. It is possible with it to find a hidden screw and grip it without seeing it at all, and as a matter of fact can be used by a blind person should it be necessary for a person so handicapped to perform simple assembly/disassembly operations or repairs. Additionally it acts as a safety shield, to prevent injury by the screwdriver tip, or against marring or scratching surfaces. It provides a positive grip for starting screws and bolts, but one which will easily release when the screw is driven home. It further makes possible accomplishing these troublesome tasks with one hand, rather than two. In its preferred embodiment, it acts as a protective device against electrical shock. It also acts as a positive device for ensuring engagement of the screwdriver tip with whatever form of screw is being used, without necessity for doing so visually.

3. Prior Art.

The May 1982 issue of Popular Science magazine (Times Mirror Magazines, 380 Madison Avenue, New York City), which is widely distributed and available, contains a summary article on the field of screwdrivers, in their various types, beginning on page 132. On page 134 there is mention of various types of screw starters or holders considered as available, with specific mention of the most common form with spring fingers or leaves which must be engaged with the head, and another with a wedge or center leaf which turns and jams in a screw slot to hold the screw on the tool bit.

As might be expected, a number of patents have issued on various devices intended to address this problem, and reference will be made to the following United States Patents known to applicant herein to have issued. They are listed below with reference letters, or reference will be by inventor's hame.

| Ref | U.S. Pat. No. | Inventor | Date |
|---|---|---|---|
| A | 355,392 | Fellers | 1887 |
| B | 601,188 | Webster | 1898 |
| C | 881,296 | Chappel | 1908 |
| D | 1,229,793 | Ryan | 1917 |
| E | 1,889,330 | Humes, et al (1) | 1932 |
| F | 1,925,385 | Humes, et al (2) | 1933 |
| G | 2,028,546 | John | 1936 |
| H | 2,566,673 | Nygaard | 1951 |
| I | 2,633,168 | Mahaffey | 1953 |
| J | 2,762,408 | Baldwin | 1956 |
| K | 2,952,285 | Roosli | 1960 |
| L | 2,954,809 | Loewy | 1960 |

These patents teach a variety of methods for variously holding or finding screws, etc, and at least one (Nygaard) provides for a set of removable bits or heads to convert it to a variable size wrench also. One (Ryan) involves a bulky box-shaped holding structure with a thumb lever which could not be used in a confined space or recess. Some of the features disclosed are the common spring-leaf fingers which must be positioned with care to hold a screw head (Fellers, Webster, Mahaffey, Baldwin and Roosli), a split tube type gripping device (Chappel, Humes 1 and 2, John, and Loewy), and various means to actuate the holding means, such as cams (John and Loewy) and double or triple sleeves or barrels which act upon each other (Humes 1 and 2, Nygaard, Baldwin and Roosli). Some aver that the device automatically releases its grip (Humes 1 and 2, and Mahaffey), while others require two-handed or double step operation to lock and/or unlock (Webster, Ryan, Fellers, Baldwin, Loewy).

The invention herein offers many advantages over the references. It provides simple operation in confined spaces, not requiring two hands or a second tool; it accurately locates the screw head and aligns the bit or blade, captures the screw easily for removal, maintains the bit in register with the screw head whether removing or driving it home. It also is easy to disengage from the screwhead after it is driven in - the spring leaf types in particular may be captured under the screw head and locked in if not disengaged earlier, an operation which may be extremely difficult in a confined space. These advantages are available in various of the references to only a limited degree, and not at all in some.

SUMMARY OF THE INVENTION

The invention comprises a multiple adaptation of a basic barrel or sleeve-type mechanism which at one end is configured to provide a gripping and holding device for screw heads, while at the other end it is provided with a simply operated clutch which allows it to be quickly locked into place on a bit or shaft of a screwdriver which it encloses.

The device is preferably made of a plastic marketed by DuPont Company under the name delrin, or a material closely resembling that in its qualities and characteristics. It could be made quite satisfactorily in brass or similar metal, but both material and fabrication costs would be greatly increased, and the basic concept of the invention is for an inexpensive set of barrel/bit combinations adapted to handle the range of standard (and other) screw sizes customarily used.

Predicated then upon the use of delrin or similar material, the invention primarily provides three adaptations of the basic barrel mechanism. First, as a screw starter, the barrel encloses a plastic bit of the same material (although it may be provided with a hardened metal tip to provide wear resistance) which is quickly insertable or exchangeable for another to match different screw types. Second, the same barrel mechanism can be placed over a standard screwdriver to act as a screwholder for driving screws home, providing an easy release capability. Third, as a combination adapted to a specific screwdriver on which it is mounted in a spring-loaded manner, and constrained as to its movement relative to the shaft of the tool, the combination provides a tool uniquely adapted to locating screws in hidden recesses, accurately registering these screws for engagement by the blade tip (of whatever type) for removing them, and gripping the head of the screw for sure retention while withdrawing it. As a variant applicable to both the second and third modes of use, the barrel can be made as a split barrel, with the screw-engaging tip mounted thereon by threads, so that the barrel can be attached over screwdrivers having wide swedged blades (grooves being provided in the engaging means for the blade); this variant is particularly adaptable to screwdrivers having shafts which are not round, e.g., square or hex-shaped.

In these different forms or models, the concept is to provide a family or set of sizes to fir the entire range of available screw sizes, and adapted to mate with the corresponding range of screwdrivers. It is possible to adapt the basic barrel mechanism to all sizes, down to and including jewelers' screwdrivers.

BRIEF DESCRIPTION OF THE DRAWINGS

FIG. 1A shows the barrel of the invention as used in its screwstarter form;

FIG. 1B shows the bit or insert of the screwstarter form of the invention;

FIG. 1C details the screw-gripping means which is used in the barrel for the screwstarter form as well as the other forms of the invention.

FIG. 2A shows an assembled tool with the barrel of this invention mated with a screwdriver for use in locating and removing screws;

FIG. 2B shows a clip ring for use in affixing a guide pin to the shaft of the screwdriver;

FIG. 2C is a detail of the guide slot in the barrel of the invention, and the guide pin protruding thereinto;

FIG. 2D shows a machine screw in a workpiece and an end view of the screw-gripping means as aligned with the head of the screw;

FIG. 3A shows an assembled tool, in the split-barrel configuration of the invention, applied to a screwdriver;

FIG. 3B is a partially exploded view indicating one half of the split barrel opened up as prior to assembly on the tool;

FIG. 3C is an end view of the screw-gripping means, here shown to indicate the slot for the widened blade of the keystone type screwdriver.

FIG. 4 shows both the clutch and collar for the screw-locator version (FIG. 2), with an additional skirt and cooperating spring for extension of the barrel towards the working end of the tool.

FIG. 5A is an end view of the tool (screw-gripping means) with a bit for a Torx screw;

FIG. 5B is a similar end view with a bit for a clutch type fastener;

FIG. 5C is a similar end view with a bit for a Scrulox or Robertson type fastener.

DESCRIPTION OF THE PREFERRED EMBODIMENT

Referring first to FIG. 1, the screw starter assembly 10 is shown with its two parts separated. The outer portion (FIGS. 1A and 1B) is barrel or sleeve 11, through the center of which is inserted bit 40. At one end of the barrel (here the left) is shown the screw-gripping portion of the tool 30, shown in greater detail in FIG. 1C. While it is shown here as being of greater diameter than the center section, this is not necessary. This screw-engaging or gripping end is basically a tube which has been slit longitudinally for a part of its length into a plurality (ideally 6) of segments 31, by slits 32. As seen in the end views in FIG.3C, the gripping tool is circular and symmetric. Due to the natural resiliency and springiness of the chosen material, segments 31 will move outward sufficiently to accept a screw head (indicated in FIG. 2D), then close upon it. The gripping means, shown in FIG. 1C consists of annular grooves 33 and rings or shoulders 34, which provide for accepting the head of a screw and retaining it by the spring pressure of segments 31. The inner faces of the shoulders 34 are inclined at an angle towards the open end of the tube, to facilitate release of the screw head, particularly when it is being driven home. In this instance, as the screw is tightened down and the end of the screw-gripping tube is being forced upon the material into which the screw is being driven, the inclined face of shoulder 34, forced against the screw head by the pressure, essentially acts as a cam to open segments 31 and release the screw head. The material used is sufficiently resilient that several sets of grooves 33 and rings 34 could accomodate a range of screw sizes, but it can be easily seen in FIG. 1C that the smaller the screw head, the farther it must extend into the gripping means 30 to be accepted. As it is unrealisitic to expect the smaller screws to be the longer, it is considered preferable to provide only two sets of grooves 33 and rings or shoulders 34 in each barrel assembly 11. As each groove/ring combination will accept up to three standard screw sizes, e.g., 6, 8 and 10, each barrel assembly 11 could be usable for six sizes. Inasmuch as a screwdriver itself is limited in the range of sizes of screws with which it will effectively mate, the use of a family of barrels is compatible with the requirement for having on hand a range of sizes of screwdrivers.

In the screwstarter application, bit 40 is inserted through barrel 11 so that end 42 is properly contained within the screw gripping means 30. The bit is preferably made of the same material, delrin, but it may be made of a harder material or provided with a harder tip to resist wear. Bit 40 is provided with a knob 41 for a grip—the knob may be color coded to indicate type of screw or size, or have a finger touch key, as shown in FIG. 1B.

The bit 40 is held fixed with respect to barrel 11, when desired, by a clutch mechanism operated by collar 20 at the opposite end of the barrel from the gripping means. The manner of operation of the clutch is shown in FIG. 4. The barrel end is formed as a truncated cone 15, which is slit into at least four segments by slots 17. (In the split-barrel model discussed below, the clutch cone must be slit into six segments). Collar 20, which is threaded onto barrel 11, has within it a concave conical surface of pitch substantially equal to that of the truncated cone. The clutch is shown in more detail in FIG. 4, where the collar is shown as 210, with threads 21 which mate with threads 16 on barrel 11, the end of which is formed into truncated cone 15, divided by slots 17 into segments 19. The concave conical surface 22 in collar 210 compresses cone 15 as the collar is threaded over barrel 11, and the segments grip the bit or shaft within. Pin 18 protrudes through slot 23 in the collar (FIG. 1A), slot 23 being parallel to the threads 21 and 16, so that it serves to limit the rotation of collar 20 to that necessary to operate the clutch, and serves to help tighten (or loosed) the clutch. The arc of travel of collar 20 need only be of the order of 45° to fully operate the clutch. This same clutch assembly is common to all the forms of the tool, as is also the screw-gripping means previously described.

Turning to FIG. 2A, there is shown a complete tool made from a modified barrel 51 assembled upon a screwdriver. In this tool, collar 210 is different from collar 20 previously described in that it is longer and has on the handle end been formed into a tube, so that a spring 211 within it provides for extending the barrel by pressing against the screwdriver handle 500. Collar 210 has the same clutch operation on the mating end of barrel 51 as described above under the screwstarter. A longitudinal slot 52 in barrel 51 (see FIG. 2B) mates with pin 50, pressed or screwed into the screwdriver shaft for constraint of lengthwise movement of barrel 51. This tool is intended and adapted especially for locating and removing screws which may be hidden in recesses, difficult to find and see. In operation, the circular segmented end of the gripping head (see FIG. 3C) will center the bit of the screwdriver by touch on the screw, then the screwdriver is pushed forward and rotated against the pressure of spring 211 (FIG. 4). When the bit registers with the slot or other shape in the screw head, the screwdriver is turned to begin to withdraw the screw, while maintaining pressure of barrel 51 against the workpiece or substance from which the screw is being withdrawn. When the screw is withdrawn sufficiently for the head to be received by one of the groove 33 and ring 34 combinations in the barrel head, collar 210 is rotated, locking barrel 51 with respect to the shaft of the screwdriver. The screw is then firmly held and will be held while it is being withdrawn.

The operation of the screwstarter 10, the construction of which was previously described, is in the opposite order from that for withdrawing screws. A screw is inserted into the screw-gripping means 30 until its head is received and held by the groove 33 and ring 34 combination. The bit 42 of the screwstarter is then pushed forward and turned until it locks with the screw - collar is then turned to lock the screw and bit in place. After the screw is started, a simple pull of the tool will release the screw.

The barrel 11 may be adapted to be assembled onto any screwdriver if desired, to hold a screw firmly and securely, then release it easily when desired. The clutch mechanism operates as previously described, a turn of the collar locking it into place lengthwise on the shaft, holding the screw. FIG. 2B shows a spring strap attachment 501, which is used for affixing a pin, such as 502, to a screwdriver shaft for use with a barrel of the type of 51, with a guide slot 52 cut into it.

In FIG. 3A is shown a split barrel form 101 of basic barrel 11, particularly adapted to and here shown mated with screwdrivers having blade tips which are widely swedged (known as keystone type), so that a standard barrel 11 cannot be slid over the tip. In FIG. 3B can be seen a partially exploded view of one-half of the split barrel 101 opened up, as prior to assembly on the tool. In this form, barrel 101 is split longitudinally in two with threaded sections 103 and 303 provided at each end for assembly of the two halves over a bit or shaft by means of threaded collars, here shown as 200 and 301. The two collars differ, in that collar 200 operates in the manner of collar 20 or 201 to operate the clutch mechanism, as previously described with reference to FIG. 4. It more precisely is analagous to collar 201, and could well be indentical for the same size regime of barrel. Collar 301, on the other hand, mates by threads 303 to barrel (assembled) 101, and provides the screw-gripping means (30), with segments 31 and slots 32 forming a symmetrically disposed gripping means as shown in the end view. As dictated by the particular purpose for this model, there are shown in the end view (FIG. 3C) wide grooves 302 to slide over the wide-swedged blade which this is meant to encompass. This model of the barrel is also particularly adaptable to use with screwdrivers which have shafts of square or other non-round configuration, as it may be so assembled over them as to be non-rotatable.

Also shown are three of the several types of special screws or fasteners to which the basic tool is easily adapted by its own insertable bit, or by assembly on a screwdriver configured for use with the selected special fastener type. In FIG. 5A is shown a Torx bit; FIG. 5B indicates a clutch fastener bit and FIG. 5C shows a bit for a Scrulox or Robertson fastener.

As stated previously, the basic barrel design can be manufactured in virtually any size, to fit the entire range of standard screwdrivers (and analagous tools) or its own bits of comparable sizes, and can be provided in sets compatible with all desired uses.

Having described my invention in several different modes and models for use, it should be apparent that further variation is possible within the scope of the disclosure and the claims set forth herein, and that such variation is intended to be encompassed herein.

I claim as my invention:

1. A barrel or sleeve of stiff but resiliently deformable material for use with an associated bit of similar material or a screwdriver inserted through said barrel and cooperating therewith, each end of said barrel being slit longitudinally into a plurality of segments symmetrically and circularly disposed, further providing that at one end the segments are relatively thin and act as resilient flexible members comprising screw-gripping means in association with annular grooves and shoulders on the interior surfaces of said segments which positively grip a screw head accepted by the flexible segments, which said segments expand outward to accept a screw head, then contract in upon it;

that at the other end, said barrel ends in a truncated cone slit into segments which are relatively short and thick, said conical surface being associated with exterior threads on the adjacent cylindrical surface of said barrel, said threads being adapted to accept a threaded collar which encloses the said conical end of the said barrel; said collar interiorly disposes a conical surface which cooperates with said truncated cone on the end of said barrel so that as the collar is advanced on said barrel by the action of said threads, the said segments of the conical end of the barrel are compressed to grip the shaft or bit within said barrel and hold said bit or shaft fixed with relation to said barrel as desired.

2. A screw starter comprising a barrel as described in claim 1, in combination with a bit of similar material, provided with a head for gripping, and inserted through said barrel to cooperate therewith.

3. A screw starter as in claim 2, wherein said insertable bit is made of a harder material or is provided with a hardened tip to resist wear.

4. A screw starter as in claim 2 or 3 wherein a set of bits is provided for use with different types or sizes of screw heads.

5. A combination wherein a screwdriver of standard configuration is inserted through the barrel as described in claim 1, and used in combination therewith as a screw starting and driving tool.

6. A barrel or sleeve as described in claim 1, in association with a screwdriver, further providing:

that the said threaded collar therein described further dispose at the end nearest the handle of said screwdriver an annular recess which accepts a coil spring placed around the shaft of the screwdriver and bearing upon said handle and said threaded collar, to extend said barrel towards the bit end of said screwdriver;

that a guide pin is rigidly but removably attached to the shaft of the screwdriver, said pin extending into or through a longitudinal slot cut in said barrel, to limit and guide the movement of said barrel relative to said shaft.

7. A barrel or sleeve of stiff but resiliently deformable material, for use with an associated bit or screwdriver, said barrel being split longitudinally so that it comprises two half-tubular sections, further providing:

at both ends of said barrel, exterior threaded sections are provided, cooperating with threaded collars to permit assembly of the barrel over a bit or shaft of a tool;

that one end of the barrel, adjacent to one of said threaded sections, be so formed as to be a truncated cone, convex to the barrel end, said cone being slit longitudinally into a plurality of relatively short, stiff segments, symmetrically disposed;

that one of the said threaded collars, to cooperate with said conical end of said barrel, dispose interiorly a concave conical surface which mates with said conical barrel end, so that as the collar is advanced on said barrel by said threaded portion, the segments at said conical end of said barrel are compressed to grip said shaft within said barrel and hold it fixed relative to said barrel;

that the threaded collar to cooperate with the opposite end of said barrel be at the unthreaded end slit into a plurality of relatively thin, flexible segments, symmetrically disposed, which act as flexible members comprising screw-gripping means, in association with annular grooves and shoulders on the interior surfaces of said segments, which positively grip a screw head accepted by said flexible segments, which said segments expand outwards to accept a screw head, then contract inward upon it;

and that further said collar comprising screw-gripping means dispose extending inwards from its open end, grooves to accomodate wide-swedged screwdriver blades.

8. A barrel as described in claim 7, wherein the interior shape of the half-tubular sections is formed to fit screwdriver shafts which are square in cross-section.

9. A barrel as described in claim 7, wherein the interior shape of the half-tubular sections is formed to fit screwdriver shafts which are of other special cross-section.

10. A barrel as described in claim 7, further providing:

that the described threaded collar which disposes interiorly a concave conical surface further dispose at its end nearest the handle of an associated screwdriver an annular recess which accepts a coil spring placed around the shaft of the screwdriver and bearing upon said collar and said handle, to extend said barrel towards the bit end of said screwdriver;

that a guide pin is rigidly but removably attached to the shaft of the screwdriver, said pin extending into or through a longitudinal slot cut in said barrel, to limit and guide the movement of said barrel relative to said shaft.

11. In association with a threaded collar interiorly disposing a concave conical surface to mate with a barrel end disposing a split cone, as described in claim 1 or claim 7, a pin affixed in the cylindrical surface of the barrel, extending into or through a slot in the threaded collar, said slot being parallel to the said threads which advance said collar, to limit the rotation of said collar to that necessary to compress or open the said segments of the said split cone.

12. In association with barrels as descirbed in claim 6 or claim 10, wherein are disposed slots for guide pins to be affixed to a screwdriver shaft, a partial band of stiff, spring-like material, on which is mounted a pin as described, said band providing for snapping over a standard screwdriver shaft for holding said guide pin for cooperation with said slot in said barrel.

* * * * *